US009797644B1

(12) United States Patent
Lowe

(10) Patent No.: US 9,797,644 B1
(45) Date of Patent: Oct. 24, 2017

(54) COLLAPSIBLE AND EXPANDABLE ICE DISPENSING TUBING APPARATUS AND RELATED DEVICES AND METHODS OF USE

(71) Applicant: Taylor Christopher Lowe, Brea, CA (US)

(72) Inventor: Taylor Christopher Lowe, Brea, CA (US)

( * ) Notice: Subject to any disclaimer, the term of this patent is extended or adjusted under 35 U.S.C. 154(b) by 0 days.

(21) Appl. No.: 15/454,553

(22) Filed: Mar. 9, 2017

(51) Int. Cl.

| | |
|---|---|
| ***F25C 5/16*** | (2006.01) |
| ***F25C 5/00*** | (2006.01) |
| ***F25D 23/02*** | (2006.01) |
| ***B67C 11/02*** | (2006.01) |

(52) U.S. Cl.
CPC ..... *F25C 5/002* (2013.01); *B67C 11/02* (2013.01); *F25D 23/026* (2013.01); *F25C 2400/12* (2013.01)

(58) Field of Classification Search
CPC ..... F25C 5/002; F25C 5/005; F25C 2400/00; F25C 5/12; B67C 11/00; B67C 11/02; F25D 23/026; F25D 23/028
See application file for complete search history.

(56) References Cited

U.S. PATENT DOCUMENTS 1,946,760 A * 2/1934 Rhine ..... B65G 11/186 193/2 R
4,600,125 A * 7/1986 Maynard, Jr. ..... B67B 7/28 141/330
4,823,554 A * 4/1989 Trachtenberg ..... A47J 36/26 62/239
5,148,842 A * 9/1992 Boust ..... B67C 11/02 141/333
6,158,564 A * 12/2000 Derelanko ..... F25C 5/005 193/2 R
6,648,187 B1 * 11/2003 Shypkowski ..... B67D 1/0042 222/527
7,748,235 B1 * 7/2010 Franklin ..... F24F 5/0017 62/186

(Continued)

OTHER PUBLICATIONS

EK USA "Ice Shoot" web page content obtained Feb. 15, 2017 from http://ekusa.com/product/ice-shoot/.

(Continued)

*Primary Examiner* — Nicolas A Arnett
(74) *Attorney, Agent, or Firm* — Lodestone Legal Group; Jeromye V. Sartain

(57) ABSTRACT

A collapsible and expandable ice dispensing tubing apparatus having a first end and an opposite second end, the apparatus comprising: a hollow flexible body having a first opening formed at the first end and an opposite second opening formed at the second end, the body comprising a sheath and at least one reinforcing member for communication through the body from the first opening to the second opening; a first collar formed on the body at the first end and an opposite second collar formed on the body at the second end; and a fastener configured to selectively engage the first and second collars so as to selectively maintain the apparatus in a collapsed configuration. The apparatus may be employed in conjunction with other devices for selectively dispensing ice from an ice dispensing machine into a container.

24 Claims, 9 Drawing Sheets

(56) References Cited

U.S. PATENT DOCUMENTS

| | | | | |
|---|---|---|---|---|
| 7,814,764 | B1 * | 10/2010 | Heater | F24F 1/04 62/476 |
| 7,886,548 | B1 * | 2/2011 | Graves | B62B 9/00 62/272 |
| 8,511,106 | B2 * | 8/2013 | Ducharme | F25C 5/005 62/344 |
| 9,091,449 | B2 * | 7/2015 | Donaldson | F24F 5/0021 |
| 2008/0047631 | A1 * | 2/2008 | Baker | B67C 11/02 141/332 |
| 2009/0000317 | A1 * | 1/2009 | Schill | A61L 2/22 62/78 |
| 2013/0233002 | A1 * | 9/2013 | Donaldson | F24F 5/0021 62/99 |

OTHER PUBLICATIONS

Icybreeze "The World's First Portable Air Conditioner & Cooler" web page content obtained Feb. 15, 2017 from http://www.icybreeze.com/.

* cited by examiner

COLLAPSIBLE AND EXPANDABLE ICE DISPENSING TUBING APPARATUS AND RELATED DEVICES AND METHODS OF USE

FIELD OF THE INVENTION

The present invention relates to generally to dispensers for ice machines, and more particularly to a collapsible and expandable hose configured for operably interfacing with ice machine dispensers at one end and for permanently or removably interfacing with containers or attachments at the opposite end.

BACKGROUND

The following description includes information that may be useful in understanding the present invention. It is not an admission that any of the information provided herein is prior art or relevant to the presently claimed invention, or that any publication specifically or implicitly referenced is prior art.

Ice is used in a wide variety of commercial and personal contexts, with a related variety of ice making and dispensing machines known. As cubed or crushed, such ice may be used to fill water bottles, hydration bladders, or other beverage containers or the like for keeping a beverage cold for later consumption or to fill a cooler or ice chest or the like to keep food, beverages, and other items or perishables cold as desired. Most often, such ice is dispensed from a refrigerator/freezer, whether within the freezer or "ice box" thereof where the "ice maker" is located or from a water and/or ice service point in the door of the refrigerator. In traditional commercial contexts, including hotels and restaurants, gyms and spas, and other such locations, industrial ice vending machines may be provided generally characterized by their relatively larger capacity and dedicated purpose of ice vending.

Such residential or commercial ice making and dispensing units typically have a built-in substantially vertically oriented chute somewhere on the front of the machine for ease of access and through which ice is dispensed, actuation often being achieved through pushing on the chute itself or on a button in the vicinity of the chute, whether by hand or with the container to be filled with ice, in either case the container, and particularly the mouth thereof, being positioned below the dispensing chute so that the dispensed ice can be directed into the container as desired. To facilitate such filling, a shelf or ledge is typically provided some distance below the chute on which the container may be placed as it is filled, with the chute itself thus being over the shelf or ledge and thus inset relative to the front surface of the ice vending machine, again whether residential refrigerator or commercial ice machine. Such shelf or ledge is also often equipped with a tray or drain to address excess dispensed ice or ice that otherwise does not make it into the desired container.

There are a number of drawbacks and challenges associated with such known means of ice dispensing, primarily centered around attempting to get ice into a variety of containers without spilling ice on the floor, which results in waste, a wet mess to clean up, and potentially a dangerous "slip and fall" situation. As noted above, in most ice machines, there is a dedicated space beneath the ice dispensing chute that is configured to accommodate a range of containers. The problem is that this physical space is inherently limited and often does not accommodate taller or odd-shaped containers, let alone coolers or ice chests or the like. As such, getting ice into such containers is not easily achieved, and therefore often involves the inconvenience of using one's hands and/or incrementally filling the desired container using some other intermediate container such as a cup. If a cooler or ice chest is to be filled, this becomes a cumbersome and time-consuming process, potentially involving a number of steps or the need for multiple people to help support the cooler in a suspended position relative to the chute for filling, even then only being able to potentially position one corner of the cooler, if that, underneath the chute. Inevitably, with any of these approaches much ice is spilled and ends up on the floor to be cleaned up, adding further time and inconvenience to the task of simply trying to fill a cooler or other container with ice. Similarly, depending on the size, shape, and location of the opening formed in the container into which ice is to be dispensed, and relatedly, how close the mouth or opening of the container can be positioned to the ice machine dispenser chute, further challenges in getting ice into the container may be presented that are simply not adequately addressed by typical chute and dispensing systems.

In an attempt to address such problems, one relatively recent product has been introduced, manufactured and sold by E.K. Ekcessories dba EK USA in Logan, Utah under the name "Ice Shoot." The Ice Shoot consists essentially of a somewhat curved rigid chute or funnel having an opening at each end sized and configured to place one such opening adjacent an ice dispensing chute and the opposite such opening on, in, or adjacent to the mouth or opening of the container to be filled with ice. However, the Ice Shoot has a number of shortcomings of its own. By being of a rigid construction, no adjustment of its length is possible to better accommodate the range of ice dispensing machines, and particularly the location or height of the dispensing chute and related size and configuration of the shelf or ledge area beneath the chute, and/or the range of containers to be filled, particularly coolers or ice chests in a variety of sizes and shapes that in most if not virtually all cases will best remain on the ground as they are filled, which again presents challenges since the Ice Shoot is of a finite and relatively short length of approximately only one foot. Relatedly, by again being of a rigid construction, the Ice Shoot is not as easily stored or transported, leading to a further practical limitation on its use. Thus, the Ice Shoot product is quite limited in its actual use and performance, essentially tailored to filling bottles and hydration bladders and the like, but again, even there not as conveniently when "on the go."

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for a device that more effectively facilitates filling a variety of containers with ice as desired from a variety of ice making and dispensing machines in a variety of contexts. Aspects of the present invention fulfill these needs and provide further related advantages as described in the following summary.

SUMMARY OF INVENTION

The present inventive subject matter provides systems and methods for effectively dispensing ice from an ice making or ice vending machine to a container using a collapsible and expandable ice dispensing tubing apparatus. Thus, one aspect of the inventive subject matter includes a tubing apparatus having first and second ends. The tubing apparatus has a hollow flexible body having a first opening formed at the first end and an opposite second opening formed at the second end. The hollow body further comprises a sheath and at least one reinforcing member for communication through the body from the first opening to the second opening. In some embodiments, a first collar is formed on the body at the first end and an opposite second collar is formed on the body at the second end. Preferably, the apparatus further includes a fastener configured to selectively engage the first and second collars so as to selectively maintain the apparatus in a collapsed configuration.

In a further embodiment, the collapsible and expandable ice dispensing tubing apparatus is employed in combination with an ice chest having a receptacle, the apparatus being configured to be selectively received within the receptacle formed in the ice chest for communicating with an interior thereof.

In a still further embodiment, the collapsible and expandable ice dispensing tubing apparatus is employed in combination with a funnel attachment, the apparatus being configured to be selectively engaged with the funnel attachment for communicating therewith.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
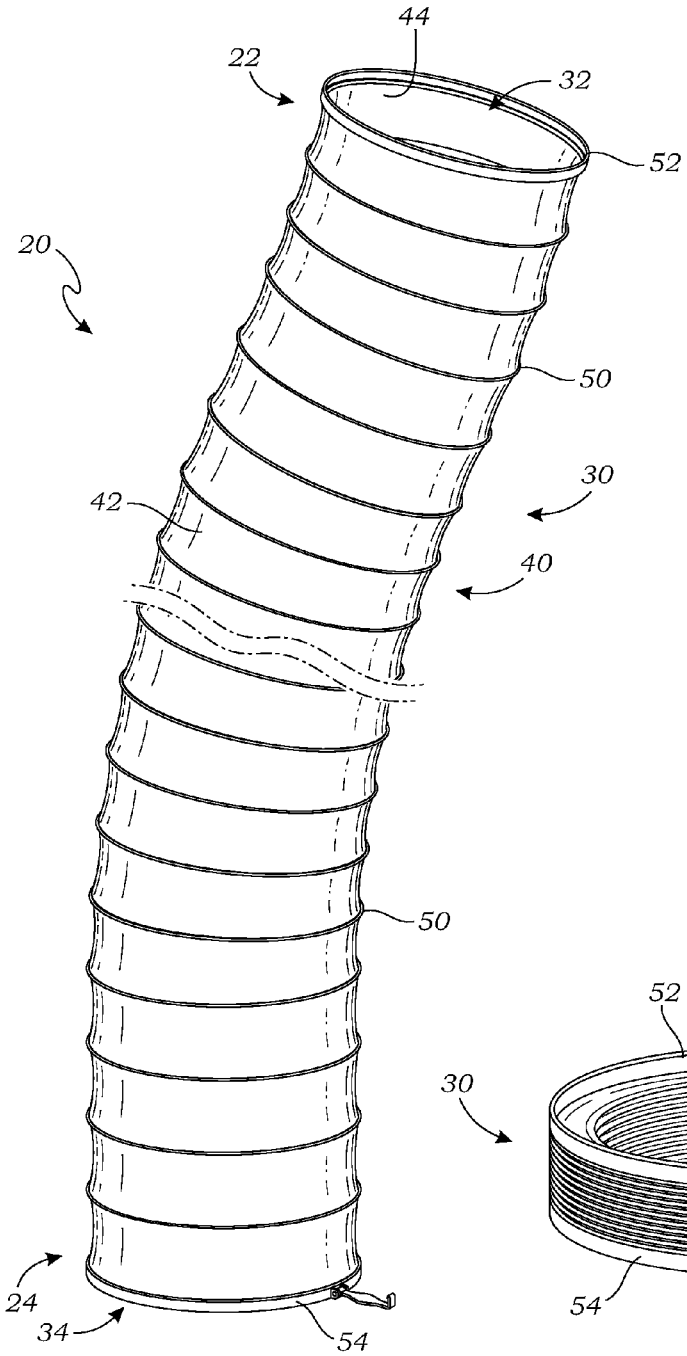
FIG. 1 is a partial perspective view of an exemplary collapsible and expandable ice dispensing tubing apparatus in an expanded first operational mode, in accordance with at least one embodiment.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modification and alternative embodiments, certain illustrated embodiments thereof are shown in the drawings and will be described below in detail. It should be understood, however, that there is no intention to limit the invention to the specific form disclosed, but on the contrary, the inventive subject matter is to cover all modifications, alternative embodiments, and equivalents falling within the scope of the claims.

FIG. 1 illustrates a partial perspective view of one embodiment of a collapsible and expandable ice dispensing tubing apparatus 20. The apparatus 20 a first end 22 and a second end 24 and comprises, in the exemplary embodiment, a flexible body 30 with a hollow lengthwise interior communicating between opposite first and second openings 32, 34 associated with the first and second ends 22, 24 of the apparatus 20. It will be appreciated that the interior of the tubing apparatus 20 thus serves as a conduit from end to end, more about which is said below regarding the apparatus 20 in use. A term "tubing" as used herein is subject to its broadest understanding as being any hollow structure that can convey material therethrough, irrespective of geometry, material, or configuration, and so expressly not limited to round, circular, or annular configurations.

The ice dispensing tubing apparatus 20 is formed of a flexible sheath 40 with a reinforcing member 50. In some embodiments, the reinforcing member is a group of spaced apart rings. In these embodiments, it is contemplated that at least two or more spaced apart rings may be connected together via a connecting link. The connecting link can be linear. However, it is contemplated that the connecting link can be nonlinear such that it can wrap around at least a portion of a surface of the sheath. In other embodiments, the reinforcing member is a helix (e.g., a single helix, a double helix, etc.).

In some embodiments, the flexible sheath further includes a first collar 52 defining or forming the first opening 32 at the first end 22 of the apparatus 20 and a second collar 54 defining or forming the second opening 34 at the second end 24 of the apparatus 20. The sheath 40 has an outer surface 42 and an opposite inner surface 44, the inner surface 44 defining or forming the interior space or conduit through the tubing apparatus 20.

It is contemplated that the sheath 40 may be formed of any suitable, relatively flexible material now known or later developed, including but not limited to polypropylene, polyethylene or Mylar polyester plastic. In some embodiments, the sheath 40, and particularly its inner surface 44, may be further formed from or treated with (e.g., coated on or impregnated or infused in the surface, etc.) a material having antimicrobial and/or antibacterial properties, or other food-grade material, to aid in maintaining the cleanliness of the tubing interior. In some embodiments, the selected material (s) of the sheath 40 are substantially waterproof and/or washable to further maintain the apparatus 20 for safe and effective use over time.

In some embodiments, the sheath material may also be transparent or translucent (at least partially) to allow a user to view, at least in part, the ice or other items passing through the tubing apparatus 20 during use. However, it is also contemplated that the sheath 40 may be opaque if desired. In other embodiments, some parts of the sheath comprise an at least partially transparent or translucent material, while other parts of the sheath comprise an opaque material.

It will be appreciated that whether transparent/translucent or opaque, the sheath material can be in any color and may have printing on it, such as to indicate expanded length or to simply provide the product name and/or instructions for use and care. The particular material selected and its inherent properties in terms of tear and puncture strength, stretch or elasticity, tensile strength, flexibility, and other such attributes would be in conjunction with the thickness of the sheath 40. Those skilled in the art will appreciate that a wide range of materials and material properties and related geometries or configurations are possible according to aspects of the present invention and are to be understood as being within the scope of the invention.

In some embodiments, the first and second ends 22, 24 or the first and second collars 52, 54 can be coupled with o at least one reinforcing member 50. Any suitable methods to coupling the reinforcing member 50 with the sheath 40 can be contemplated. For example, the reinforcing member 50 can be immobilized on the sheath 40 by molding or over-molding, extruding or co-extruding, bonding, and welding. In some embodiments, the reinforcing member 50 can be immobilized on the sheath 40 permanently. In other embodiments, the reinforcing member 50 can be immobilized on or engaged with the sheath 40 removably and/or nonpermanently so that worn or damaged reinforcing member 50 can be easily removed and/or replaced with another or substituted with different types (or shapes) of the reinforcing members to change the overall size or configuration of the apparatus 20. In any case, the result may be that the one or more reinforcing member 50 is fully embedded or integrated in the sheath 40 or may be visible or accessible from one or both sides or surfaces 42, 44 of the sheath, again depending on a number of considerations. The one or more reinforcing member 50 and the first and second collars 52, 54 may be operably arranged with the sheath 40 in the same manner or different manners and may be formed of the same or different materials.

The one or more reinforcing member 50 and the first and second collars 52, 54 may be formed of any suitable material(s), including but not limited to metals such as steel, aluminum, aluminum alloy and other alloys, and the like and a variety of plastics such as polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, and other such plastics, thermoplastics, thermosetting polymers, and the like. Any such material selected may be of varying hardness or stiffness, ranging from relatively rigid materials to more elastic or flexible materials, more about which is said below. It will be appreciated by those skilled in the art that while discrete, spaced-apart reinforcing members 50 are shown, instead a single helical or spiral reinforcing member 50 along all or a portion of the sheath 40 is also possible. Those skilled in the art will further appreciate with regard to the one or more reinforcing member 50 that where it is configured as a unitary spiral or helical component, it would preferably be flexible so as to accomplish or facilitate the desired selective expansion and collapse of the tubing apparatus 20, while where a plurality of separate, spaced-apart reinforcing members 50 are employed, such can be relatively more rigid, with the expansion and collapse of the apparatus 20, and the body 30 specifically, being achieved by the sheath 40 alone. In either case, it will be appreciated that such reinforcing member(s) 50 are included so as to provide additional structural integrity to the device 20. Moreover, in other embodiments, no such reinforcing member 50 may be employed at all, the sheath 40 itself providing all of the range of movement in terms of expansion and contraction of the tubing apparatus 20 and the attendant mechanical integrity that is required, whether by stretching and/or compression, folding, or the like. It will be appreciated that a variety of such configurations of the components and arrangements thereof is possible according to aspects of the present invention, such that any particular configuration as shown and described is to be understood as illustrative and non-limiting.

Figure 2:
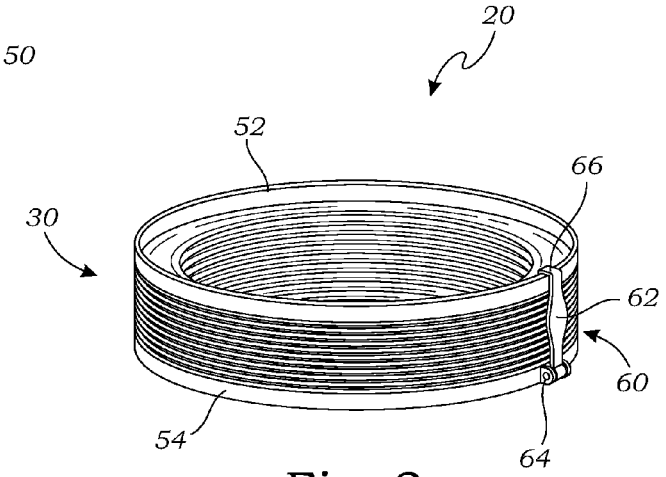
FIG. 2 is an enlarged perspective view thereof in a collapsed second operational mode, in accordance with at least one embodiment.

With reference to the perspective views of FIGS. 1 and 2, dimensionally, and by way of illustration and not limitation, the tubing apparatus 20 may have an overall outside dimension, or diameter in the case of an annular configuration, of on the order of six inches (6 in.), though those skilled in the art will again appreciate that a variety of sizes are possible to suit particular contexts. A size of this order of magnitude will produce a good flow rate of ice or other solids with little to any chance of blockage and will also accommodate a variety of ice dispensing machine chutes as explained further below in connection with FIG. 3. Once more, a variety of shapes or cross-sectional profiles of the tubing apparatus 20 are possible without departing from the spirit and scope of the invention. It will be further appreciated that the expanded length of the tubing apparatus 20 as illustrated in FIG. 1 may vary greatly, depending on a number of factors, including the nominal or "at rest" size of the sheath 40 and its related properties and the configuration and number of the reinforcing member(s) (as in discrete rings or coils in the case of a unitary spiral or helical configuration). With or without any reinforcing member(s) 50, the overall construction of the body 30 will dictate the size to which it may be expanded as shown in FIG. 1 or collapsed as shown in FIG. 2.

As illustrated in FIG. 1, the apparatus 20, and the body 30 particularly, is substantially expanded in a first operational mode, to the point that the sheath 40 is substantially straightened or stretched out and taut between adjacent reinforcing members 50. The expanded tubing apparatus 20 is shown partially as by being cut in the middle simply to illustrate indeterminate length in the view of FIG. 1. By way of example, the nominal expanded length of the apparatus 20 may be on the order of three to four feet (3-4 ft.), though once more it will be appreciated that a variety of sizes to suit particular contexts are possible without departing from the spirit and scope of the invention.

FIG. 2 represents the apparatus 20 in a compressed second operational mode as when the device is to be stored and/or transported for later use. Where one or more reinforcing member(s) 50 are employed, their size (e.g., cross-sectional diameter or thickness) times the number of such members 50 (or coils with a single member 50) along with the heights or thicknesses of the first and second collars 52, 54 will set a nominal collapsed height of the apparatus 20. By way of illustration and not limitation, the nominal three- to four-foot expanded length tubing apparatus 20 may have twenty reinforcing members 50 spaced approximately two inches (2 in.) apart. With a nominal thickness of one eighth inch (⅛ in.) for each of the twenty reinforcing members and a three-eighth inch (⅜ in.) thickness of each of the two collars 52, 54, the nominal height of the apparatus 20 in its collapsed state as illustrated in FIG. 2 would thus be approximately three to three-and-a-half inches (3-3.5 in.), while if the members 50 were closer to one sixteenth inch (1/16 in.) thick the overall height of the collapsed apparatus 20 would then be closer to approximately two inches (2 in.).

Ultimately, it will be appreciated that a variety of such design factors, also including varying the number of members 50 (discrete rings or coils) and the size of one or both of the collars 52, 54 as well as the thickness and properties of the sheath 40 itself, all contribute to the collapsed height of the tubing apparatus 20, such that all such configurations and related dimensional call-outs are to be understood as merely illustrative and non-limiting. Those skilled in the art will appreciate that having a relatively small collapsed size, both in height and width (or again, diameter if the apparatus 20 is annular) contributes to its convenient portability—that is, by being collapsible and relatively small and lightweight, the apparatus 20 is thus relatively easily stored and transported. It is thus again noted and is to be appreciated that the ice dispensing tubing apparatus 20 according to aspects of the present invention is not limited to a particular geometry or any particular size, shape, or configuration. Accordingly, while the tubing apparatus 20, and particularly the body 30 comprising the sheath 40 and reinforcing member(s) 50 and collars 52, 54 is shown as being substantially annular or round, such is not required; rather, a tubing apparatus 20 according to aspects of the present invention may also be oval, triangular, square, or any other shape in profile without departing from the spirit and scope of the invention. Similarly, the length of the apparatus 20, both expanded and collapsed, can also vary widely based on a number of factors, the invention not being so limited. As noted above, the desired collapsed height or thickness of the tubing apparatus 20 would dictate, in part, the number and configuration (e.g., thickness) of the one or more reinforcing member(s) 50, and vice versa. All such iterations of the apparatus 20 are contemplated and should be considered to fall within the spirit and scope of the invention.

Briefly with continued reference to FIG. 2, when not in use and in its collapsed state, or the second operational mode as herein described, the ice dispensing tubing apparatus 20 according to aspects of the present invention may be configured with a fastener 60 to maintain the apparatus 20 in such collapsed state. In the exemplary embodiment, the fastener 60 comprises a hinged clasp 62, which is pivotally fixed to the second collar 54 via a hinged mount 64 and is formed at its opposite free end with an angled lip 66 configured to selectively clip, slide, or otherwise fit over the first collar 52, thereby maintaining the first and second collars 52 a fixed distance apart as effectively set by the geometry of the clasp 62. Those skilled in the art will appreciate that to the extent the tubing apparatus 20, and the body 30 particularly, is biased toward its expanded configuration as by being compressed into the collapsed mode against what is essentially a spring force supplied by the sheath and/or the reinforcing member(s) 50 in any configuration, the fastener 60 thereby held in tension in the position as shown in FIG. 2 by such inherent spring force thus maintains the tubing apparatus 20 in such collapsed configuration. Then, when the apparatus 20 is to be used, or shifted into some expanded configuration, the fastener 60 is removed or disengaged simply by pivoting the clasp 62 away from the body 30 about the hinged mount 64 so as to take the lip 66 out of contact with the first collar 52 and free the collars 52, 54 to move away from or relative to one another, as manipulated by a user and/or under the biasing effect of the tubing body 30.

It will be appreciated that while the fastener 60 is shown as being pivotally mounted on the second collar 54 and clipping on or over the first collar 52, the same arrangement could be employed in reverse, such that the fastener 60 is pivotally mounted on the first collar 52 and clips on or over the second collar 54 instead, which may be particularly beneficial when the apparatus 20 is to be removably installed in the receptacle 74 of the lid 72 of a purpose-built ice chest 70 as described further below in connection with FIGS. 4-7. Though one such fastener 60 is shown, two or more may be employed as well spaced about the apparatus 20. Further, a variety of other temporary or selective fastening means now known or later developed may be employed in addition or instead, alone or in any combination, such fastening means including but not limited to elastic straps, Velcro hook-and-loop fasteners, magnetic closures, snap or keyed mating surfaces, and the like. Accordingly, the particular clasp-type fastener 60 shown and described is to be understood as merely illustrative and non-limiting of the features and aspects of the present invention.

Figure 3:
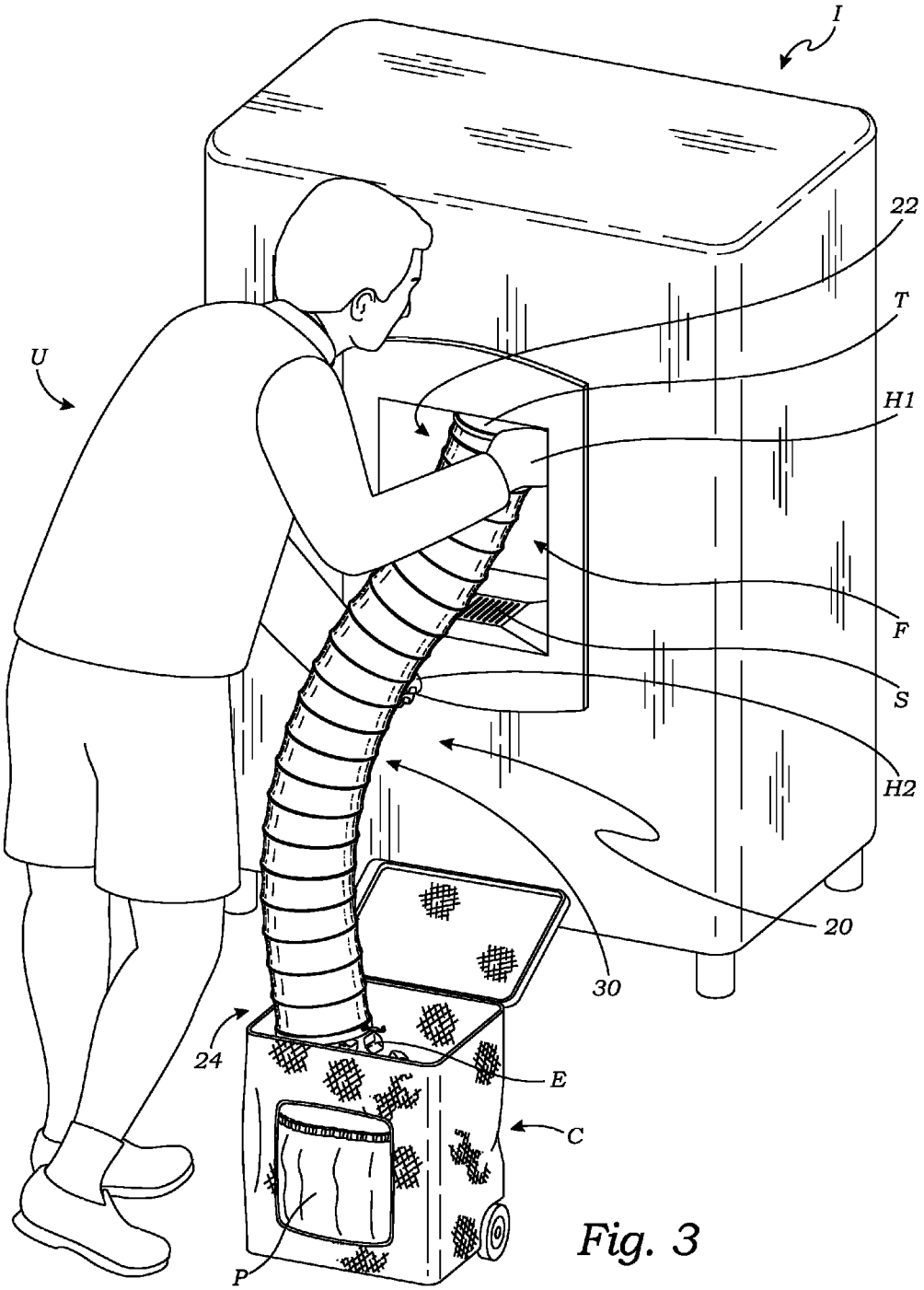
FIG. 3 is a reduced scale perspective view thereof in an expanded third operational mode in conjunction with a cooler and an ice dispensing machine, in accordance with at least one embodiment.

FIG. 3 illustrates the exemplary ice dispensing tubing apparatus 20 of FIGS. 1 and 2 now in use in an expanded third operational mode in conjunction with a cooler C and an ice dispensing machine I. As shown, a user U desires to fill a conventional hard- or soft-sided cooler C with ice from the ice dispensing machine I. The conventional ice dispensing machine I shown here has a chute T, here somewhat obscured by the upper first end 22 of the tubing apparatus 20, operably positioned in the upper end of the machine's recessed fill area F having a shelf S at its lower end opposite the chute T. As will be appreciated, such an ice machine fill area F is often sized and configured for accommodation of beverage containers or the like, but not coolers such as the rolling cooler C shown, making it a challenge to get ice from the machine I into the cooler C without inconvenience or mess. Often dispensing of ice into such a cooler C entails trying to lift the cooler C with one hand so as to at least get one corner beneath the chute T and then operating the chute T with the other hand, which is no small task, particularly if the cooler C already contains food or beverage items or the like and so is relatively heavy, then only getting heavier as it is filled with ice. Without the present invention, the other alternative is to use a cup or other container that fits within the fill area F to fill and then dump ice into the cooler C from the machine I, which assumes such an empty container is available; otherwise, the user U may be left with no alternative but to use his hands H to transfer ice from the machine to the cooler C, which is messy, inconvenient, and, depending on the use of the ice, unsanitary. Of course, as noted in the Background section above, there is also the possibility of using the third-party Ice Shoot product (not shown) to get ice from the machine I into the cooler C, but this again assumes such is available, as it being rigid and un-collapsible is not as readily stored and transported for "off-site" or "away" uses; the Ice Shoot also having a finite and relatively short length, its outlet would still be positioned quite a distance above the cooler C if the cooler C is to remain on the ground during filling. Inevitably and inconveniently ice is spilled on the surrounding floor and wasted with all such prior art approaches to filling a relatively larger container such as the illustrated cooler C with ice from a conventional ice dispensing machine I, here shown as an industrial-type machine but the comments herein and benefits of the present invention applying with equal force to a residential or consumer refrigerator or the like, such as having ice service in the door (not shown).

Accordingly, in use of the tubing apparatus 20 according to aspects of the present invention, it may simply be expanded to the desired length as shown so as to position its upper or first end 22 adjacent to the ice machine chute T and its lower or second end 24 in the open cooler C. Accordingly, with the apparatus 20 so positioned, operation of the ice machine I as by actuation of the chute T, usually by simply pressing on the chute T, causes ice E to be dispensed from the chute T and pass through the body 30 of the apparatus 20 and into the cooler C as illustrated, all with the cooler C simply wheeled over to and remaining on the ground adjacent to the ice dispensing machine I. In a bit more detail, the user U may simply grasp the body 30 of the apparatus 20 near its upper first end 22 with one hand H1 so as to position the upper first opening 32 (FIG. 1) about or adjacent to the outlet of the chute T. The user U may then grasp the apparatus 20 with his other hand H2 at some intermediate location between the first and second ends 22, 24 or at the second end 24 itself so as to direct and steady the second end 24 at the desired location in or adjacent to the cooler C for dispensing.

While the apparatus 20 in the exemplary embodiment is thus held or manually operated as desired adjacent to the ice machine chute T, it will be appreciated that particularly the upper first collar 52 may be sized and configured to have more of a press- or interference-fit engagement with the chute T, for example, for hands-free operation.

Once the desired amount of ice E has been dispensed, the apparatus 20 can then simply be removed from the machine I and cooler C, whether in any sense attached to or engaged with either or just positioned during use adjacent thereto, and collapsed back to its storage or non-use configuration as illustrated in FIG. 2. Those skilled in the art will appreciate that the apparatus 20 so collapsed is then easily stored and transported, even with the cooler C itself as by being inserted in a pocket P thereof. It will once again be appreciated that the tubing apparatus 20 according to aspects of the present invention may thus be easily and advantageously employed in a variety of contexts beyond the illustrated industrial ice vending machine I and soft-sided rolling cooler C without departing from the spirit and scope of the invention.

FIGS. 4-7 show various views and operational modes of alternative exemplary embodiments, in which an ice dispensing tubing apparatus 20 is incorporated within an ice chest 70. As a threshold matter, while a somewhat rectangular, hard-sided, otherwise conventional ice chest 70 is shown, it will be appreciated that a variety of other coolers, ice chests, or the like may be configured to permanently or removably accommodate the tubing apparatus 20 and enable its use therewith, such that the exemplary ice chest 70 is to be understood as merely illustrative and non-limiting.

Figure 4:
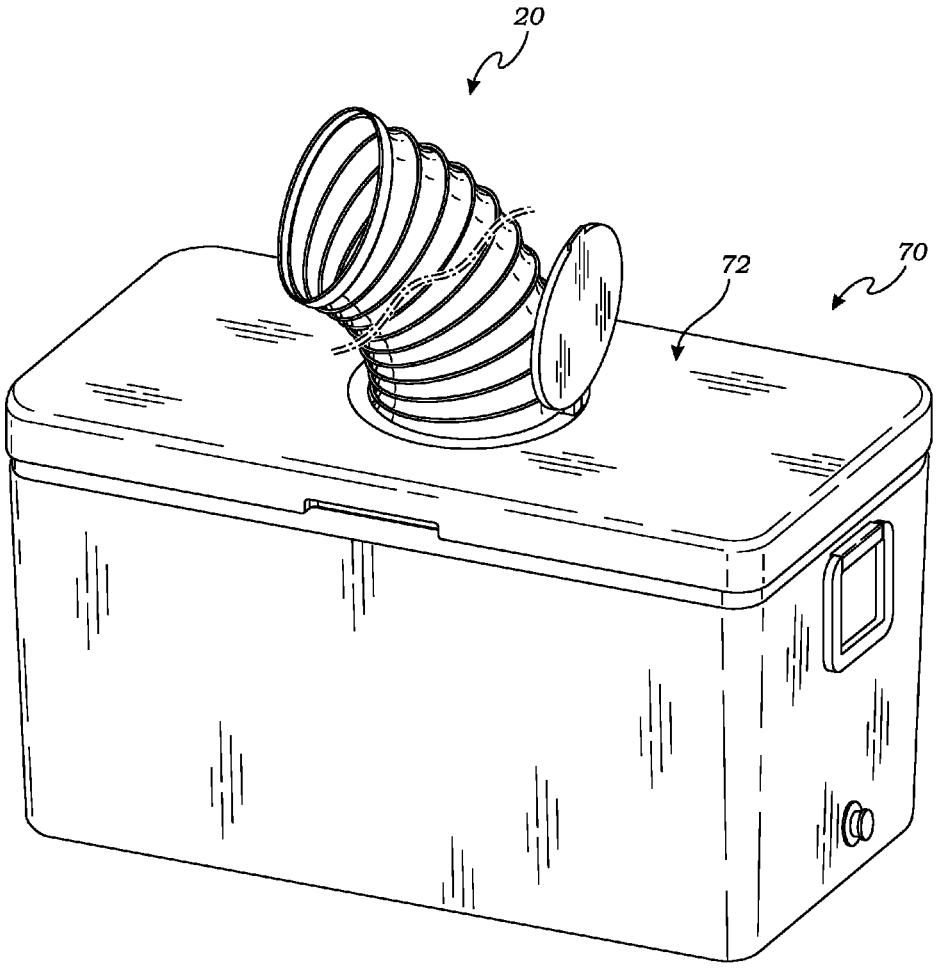
FIG. 4 is a reduced scale partial perspective view thereof in an expanded fourth operational mode in conjunction with an ice chest, in accordance with at least one embodiment.
Figure 5:
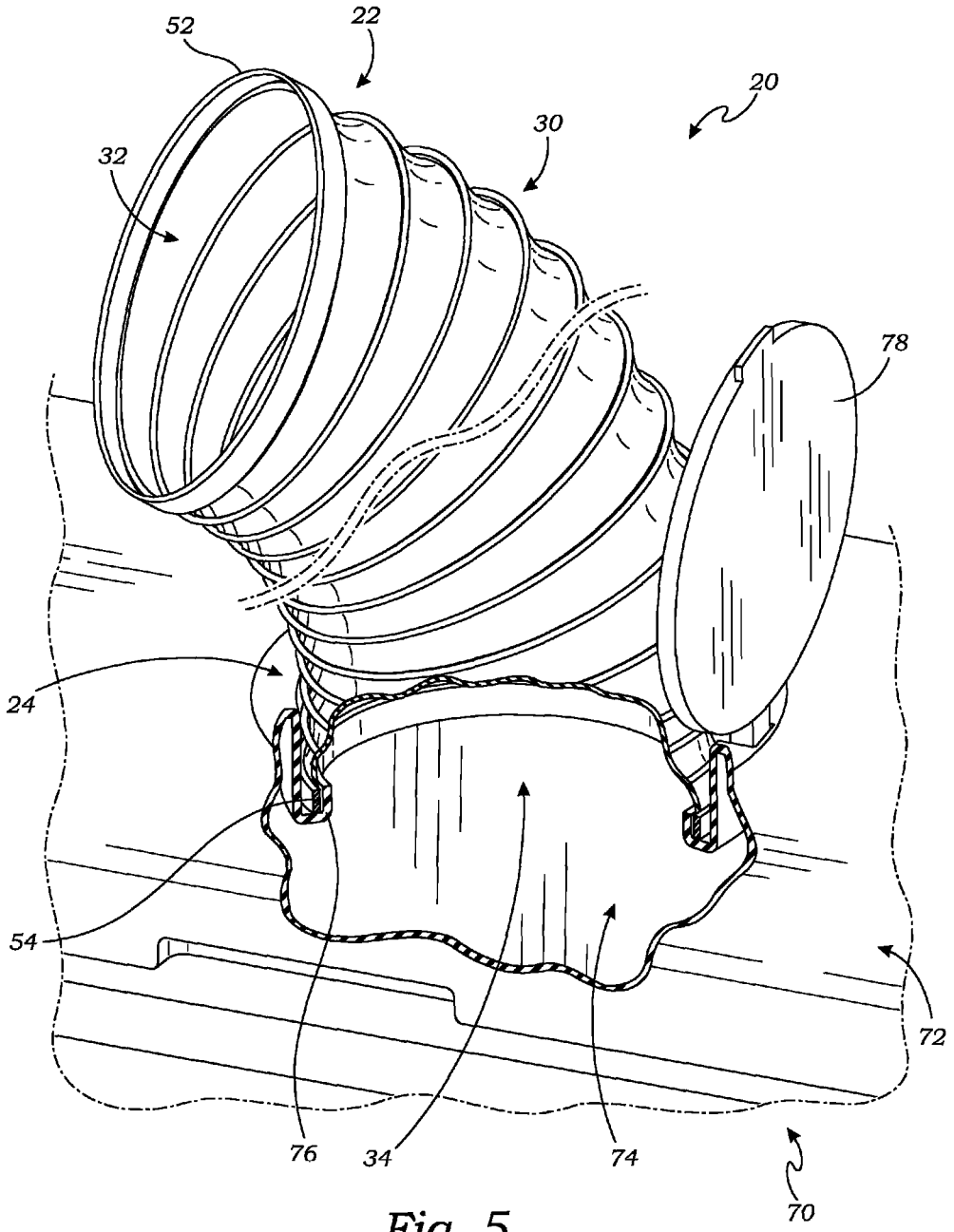
FIG. 5 is an enlarged partial perspective view thereof in the fourth operational mode in conjunction with an ice chest as shown in FIG. 4, in accordance with at least one embodiment.

As shown in the perspective view of FIG. 4, an exemplary tubing apparatus 20 of indeterminate length is installed within the lid 72 of the ice chest 70. Again, in alternate embodiments not shown, the apparatus 20 may instead be incorporated in another area of the lid 72, in a wall or location on the ice chest 70 other than the lid 72, or again in a container other than the illustrated ice chest 70. As best seen in the enlarged partial perspective view, partially in section, of FIG. 5, in the exemplary embodiment the lid 72 of the ice chest 70 is formed having a receptacle 74 defining an opening through the lid 72 so as to selectively communicate between the outside and inside of the ice chest 70. A hinged door 78 is operably configured adjacent to the receptacle 74 for selectively closing such opening when access to or through the receptacle 74 is not needed, more about which is said below. The receptacle is formed with an upwardly-opening flange 76 for selective receipt of the lower second end 24 of the apparatus 20. Particularly, in the exemplary embodiment, the flange 76 is configured for receipt of the second collar 54 formed at the second end 24 of the apparatus 20, which again defines and/or maintains the second opening 34 of the body 30. As shown, the second collar 54 may fit in or over the flange 76 as by an interference- or press-fit (i.e., frictional engagement), which may be achieved whether the second collar 54 is relatively rigid or flexible/elastic. Those skilled in the art will appreciate that the engagement of the lower second collar 54 and thus of the tubing apparatus 20 with the flange 76 formed in the receptacle 74 of the ice chest lid 72 may be by any means now known or later developed, and whether permanent or temporary, including but not limited to interference-fit or press-fit, threaded engagement, bayonet coupling, magnetic engagement, Velcro hook-and-loop fasteners, snaps, bonding, welding, and the like. Accordingly, the illustrated arrangement with the receptacle flange 76, which engagement with the second collar 54 may itself be permanent or removable as desired, is to be understood as merely exemplary and non-limiting.

It should be appreciated that in such embodiment with the receptacle 74 and flange 76 that such are formed of similar geometry to the tubing apparatus 20 that is to be permanently or temporarily/removably stored therein. Continuing with the exemplary embodiment, those skilled in the art will appreciate that the depth of the flange 76 may be selected or configured as appropriate to accommodate the collapsed height of the tubing apparatus 20 such as illustrated in FIG. 2, whereby the door 78 may then be closed to house and conceal the tubing apparatus 20, as best seen in connection with FIGS. 7A and 7B, and to generally close off the interior of the ice chest 70 so as to maintain its reduced temperature relative to ambient temperature.

Figure 6:
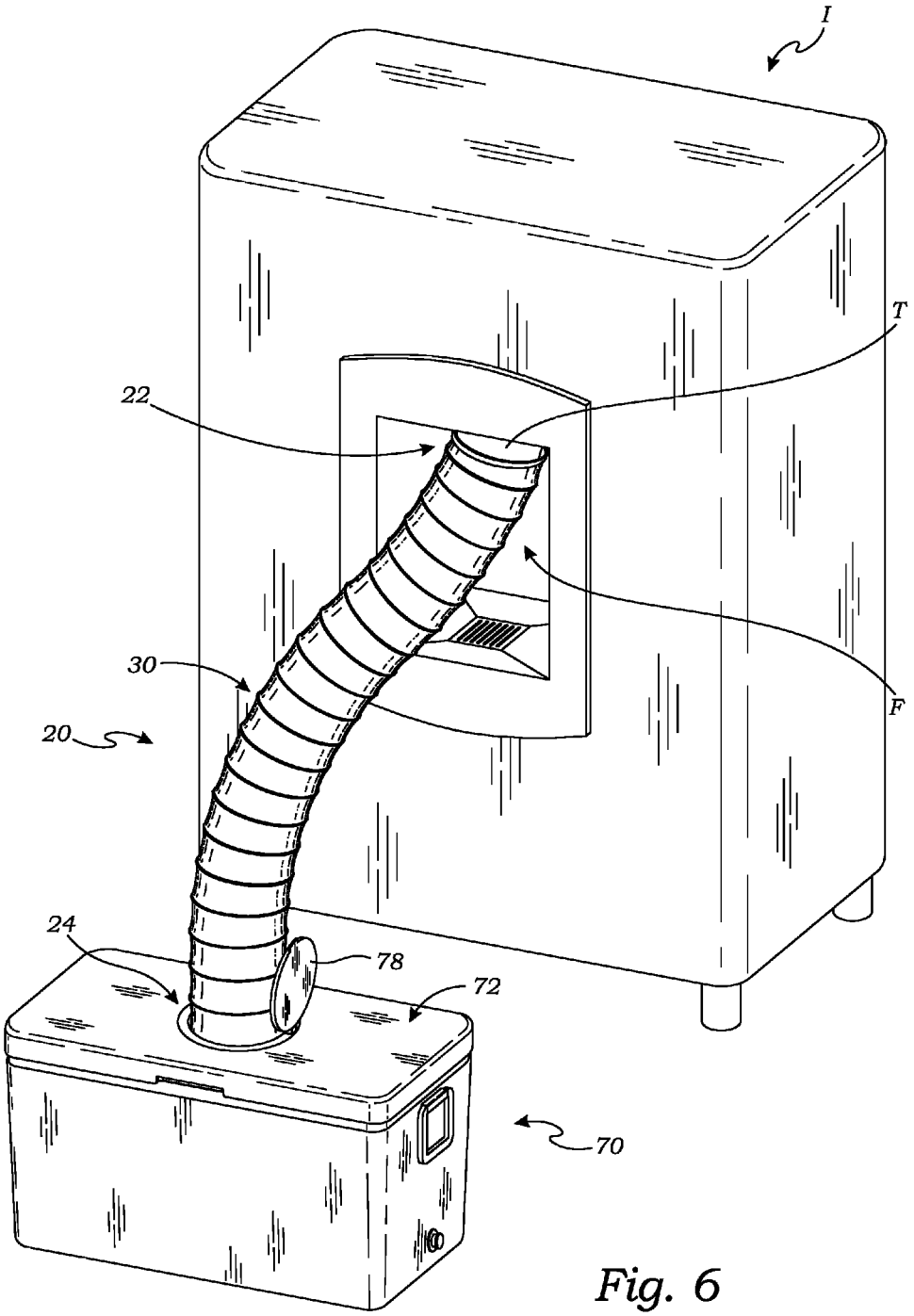
FIG. 6 is a reduced scale perspective view thereof in an expanded fifth operational mode in conjunction with an ice chest now in further conjunction with an ice dispensing machine, in accordance with at least one embodiment.
Figure 7A:
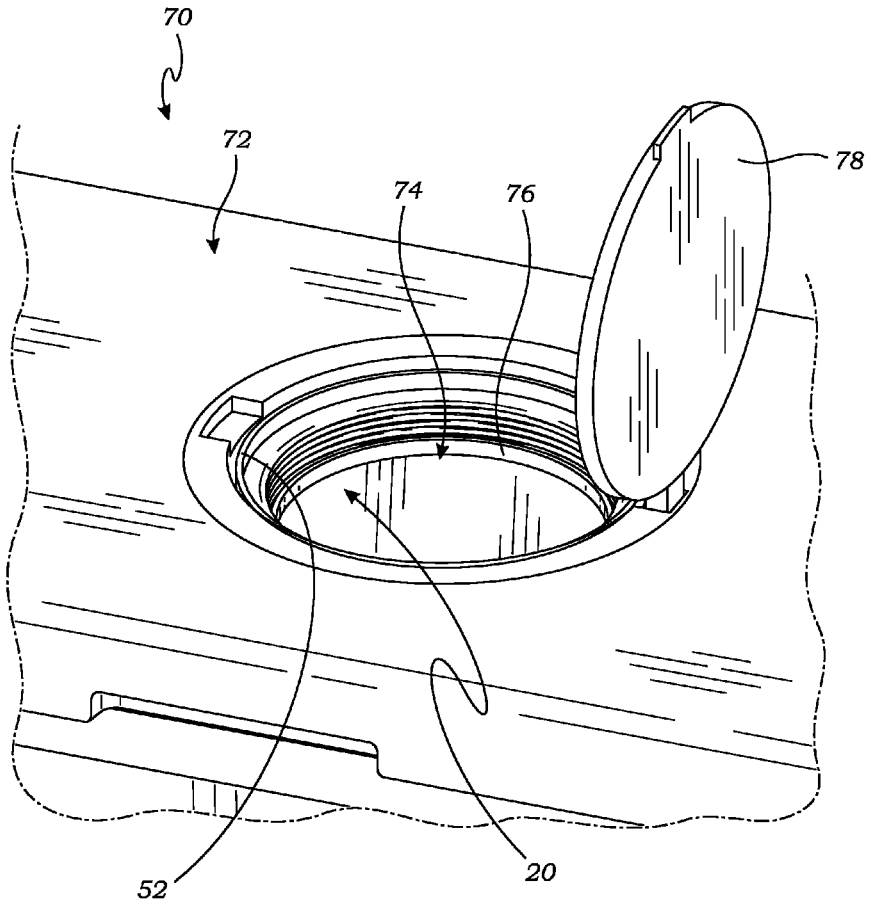
FIG. 7A is an enlarged partial perspective view thereof in a collapsed sixth operational mode in conjunction with an ice chest, in accordance with at least one embodiment.
Figure 7B:
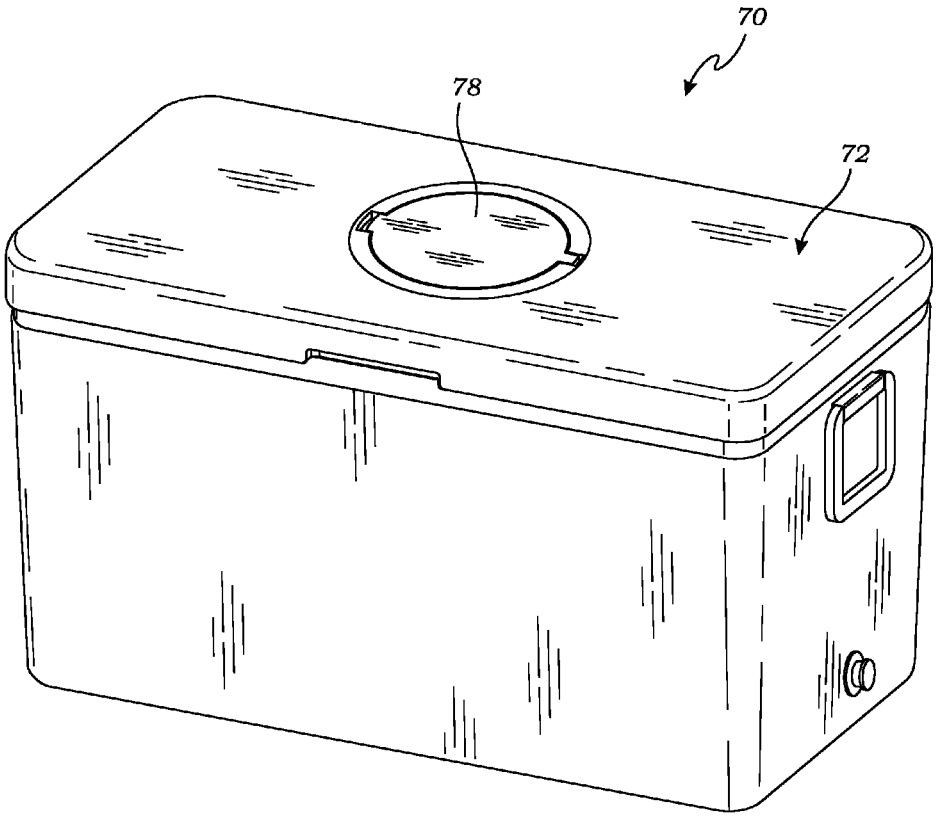
FIG. 7B is a reduced scale perspective view thereof in the collapsed sixth operational mode in conjunction with an ice chest as shown in FIG. 7A, in accordance with at least one embodiment.

Referring next to FIG. 6, in use, the purpose-built ice chest 70 may be positioned on the floor adjacent to an ice dispensing machine I in much the same way that the cooler C illustrated in FIG. 3 was positioned. Rather than opening the entire lid 72 of the ice chest 70, though, here only the receptacle door 78 formed in the lid 72 is selectively and temporarily opened as shown so as to access and remove or expand the tubing apparatus 20 housed therein, as by lifting the free or first end 22 up and away from the lid 72 and toward the ice machine fill area F so as to then position the first end 22 on or adjacent to the chute T in much the same manner as previously discussed and shown in connection with FIG. 3, while the opposite second end 24 remains engaged with and located within the receptacle 74 (FIG. 5) formed in the lid 72. Here, while no user is illustrated as holding the apparatus 20 in the desired or operable position, such may again be the case, or instead the first end 22 may simply be secured on or about the chute T as through an interference- or press-fit or some other engagement means. In any event, with the tubing apparatus 20 so positioned, the chute T or other control may again be operated so as to selectively dispense ice (not shown) from the machine I, except that here such ice passes through the body 30 of the tubing apparatus 20 and out the lower second end 24, or the second opening 34 (FIG. 5) more specifically, and through the receptacle 74 (FIG. 5) formed in the lid 72 so as to ultimately and conveniently be dispensed into the ice chest 70, again, all while the ice chest 70 remains on the ground with its lid 72 closed, advantageously further minimizing any possibility of ice loss or spillage and effectively keeping the ice chest 70 closed to the environment even while being filled with ice, the interior space of the ice chest 70 only communicating through the tubing body 30 essentially with the interior space of the ice dispensing machine I itself. Then, as illustrated in FIGS. 7A and 7B, when the desired amount of ice has been dispensed into the ice chest 70, the tubing apparatus 20 may simply be removed from the machine I, whether in any sense attached to or engaged with the chute T or just positioned during use adjacent thereto, and collapsed back to its storage or non-use configuration and the door 78 then closed thereover to again conveniently and effectively house and conceal the tubing apparatus 20 within the lid 72 of the ice chest 70.

It will also be appreciated with specific reference to the door 78 that it may be configured in a variety of ways beyond the single hinged connection to the lid receptacle 74 and may be made from a variety of materials now known or later developed, particularly those with desired insulating properties. Relatedly, though not shown, the receptacle 74 and/or door 78 may be formed with seal material such as a rubber gasket or the like on or about their respective perimeter contacting surfaces to further seal off the interior space of the ice chest 70 from the environment when the tubing apparatus 20 is not being used to fill the ice chest 70 through the receptacle 74 and the door 78 is thus closed, as also facilitated by the depth of the flange 76 so as to allow entire apparatus 20 to be contained within the receptacle 74.

Relatedly, and again noting that the body 30 of the tubing apparatus 20 may be sufficiently resilient so as to have a tendency to expand or thus exert a spring-type force, it follows that such tubing apparatus 20, assuming it is not separately fastened in its closed or collapsed state as illustrated in FIG. 2 with the first exemplary embodiment, would have a tendency to push up against the bottom or back side of the door 78, thereby potentially opening the door 78. As such, the door 78 may be formed, for example, opposite its hinge, with a latch of some kind (not shown), whether now known or later developed, so as to positively close the receptacle 74 and maintain the tubing apparatus 20 in the collapsed state within the lid 72. It will be appreciated that the upper first end 22 of the tubing apparatus 20, and the first collar 52 specifically, would thus have a tendency to seal against the back or underside of the door 78, thus further sealing off the interior space of the ice chest 70, from the environment, which is one more reason that it may be desirable to form the first collar 52, in whole or in part, of a resilient material, which would again facilitate sealing against the door 78 when the apparatus 20 is not in use and in the closed position and against the ice machine chute T when the apparatus 20 is in use. Finally, as best seen in FIG. 7B, it is desirable that the door 78 when closed be inset somewhat within the receptacle 74 (FIG. 5) so that the top or upper surface of the door 78 is substantially flush with the top or upper surface of the lid 72 when the door 78 is closed.

Figure 8A:
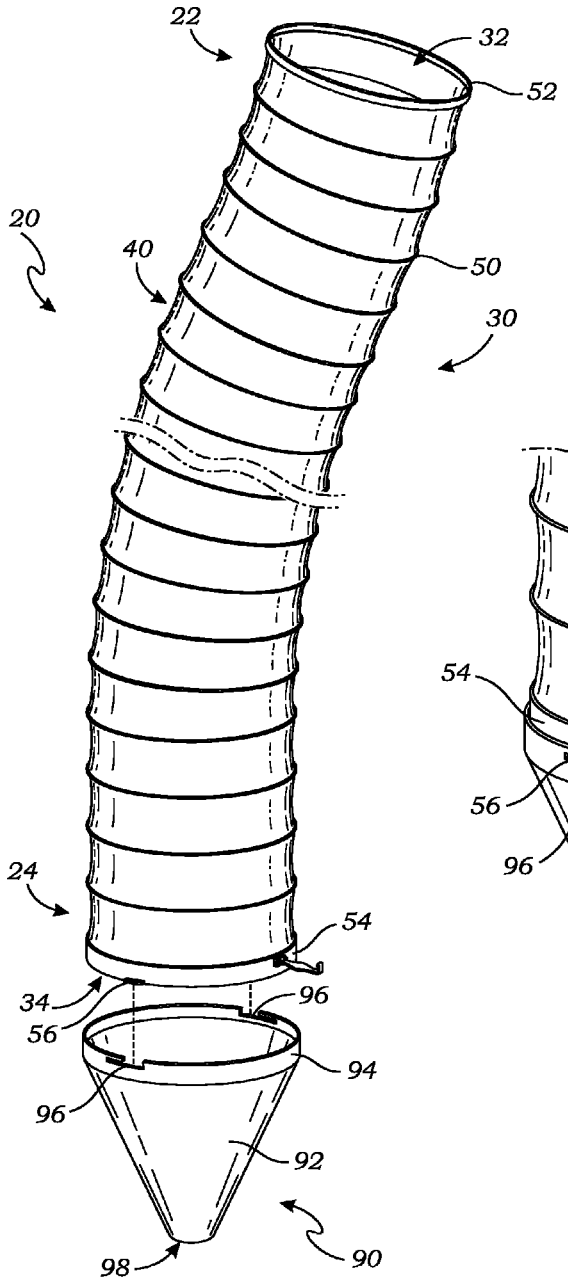
FIG. 8A is a partial exploded perspective view of an alternative exemplary collapsible and expandable ice dispensing tubing apparatus in an expanded first operational mode in conjunction with a funnel attachment, in accordance with at least one embodiment.
Figure 8B:
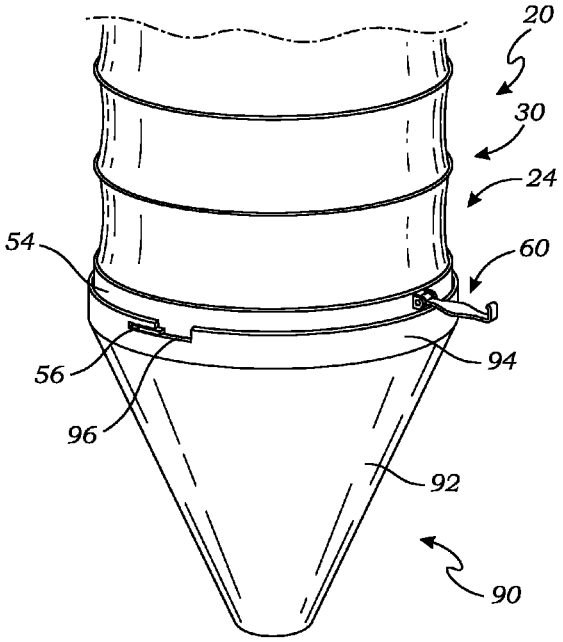
FIG. 8B is an enlarged partial assembled perspective view thereof, in accordance with at least one embodiment.

FIGS. 8A and 8B show perspective views of another exemplary embodiment, in which an ice dispensing tubing apparatus 20 is configured to be selectively coupled with a funnel attachment 90, which would be beneficial when filling a container having a relatively smaller opening, and certainly smaller than any opening in a cooler or ice chest or the like, such as a beverage bottle B, as will be further appreciated from the below discussion with reference to FIG. 9.

First, as shown in the exploded view of FIG. 8A, the funnel apparatus 90 may comprise a substantially hollow conical wall or cone 92 having a relatively larger opening formed or defined by the rim 94 and an opposite relatively smaller opening formed or defined by an outlet hole 98. Those skilled in the art will appreciate that such funnel apparatus 90 in its basic construction is typical; accordingly, it will be further appreciated that the funnel attachment 90 may be formed from any materials and by any process, now known or later developed, suitable for such use in passing ice or other items therethrough. Accordingly, as noted regarding the body 30 of the tubing apparatus 20 and its components, including the sheath 40 itself, such material of construction for the funnel attachment 90 may include but is not limited to metals such as steel, aluminum, aluminum alloy and other alloys, and the like and a variety of plastics such as polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, and other such plastics, thermoplastics, thermosetting polymers, and the like; any such material selected may be of varying hardness or stiffness, ranging from relatively rigid materials to more elastic or flexible materials.

Furthermore, the inner surface of the cone 92, also coming into contact with the ice or other consumables passing therethrough, may be further formed from or treated with a material having antimicrobial and/or antibacterial and other such properties, or other food-grade material, to aid in maintaining the cleanliness of the assembly or complete flow path from the dispenser to the container being filled, such agent either forming the interior surface of the cone 92 or being coated on or impregnated or infused in such surface.

With respect to the funnel attachment 90 in FIGS. 8A and 8B, it can be seen that the rim 94 is formed having one or more keyed or L-shaped slots 96 for selective engagement with the tubing apparatus 20, which may be formed on its lower second end 24 with means for selectively and removably engaging the funnel apparatus 90 therewith. In the exemplary embodiment, specifically, the lower second collar 54 may be formed with one or more outwardly-extending tabs 56 configured to engage the one or more slots 96 formed on the rim 94 of the funnel attachment 90. Accordingly, it will be appreciated that the funnel attachment 90 can be selectively and removably engaged with the tubing apparatus 20 in the conventional "bayonet mount" or "bayonet coupling" style connection, wherein with the openings in the L-shaped slots 94 on the funnel apparatus 90 aligned with the tabs 56 on the second collar 54 of the tubing apparatus 20, the tubing apparatus 20 and the funnel attachment 90 may be shifted axially toward one another until the second collar 54 and rim 94 are engaged concentrically as the tabs 56 bottom in the slots 96; then, with a twist of the tubing apparatus 20 and the funnel attachment 90 relative to one another they would thus be "locked" together as by the tabs 56 being seated within the L-shaped slots 96. Those skilled in the art will appreciate that a variety of other temporary engagement means between the components are possible, both now known and later developed, including but not limited to interference-fit or press-fit, threaded engagement, bayonet coupling, magnetic engagement, Velcro hook-and-loop fasteners, snaps, and the like. And within the "bayonet coupling" exemplary context, it will be further appreciated that a variety of shapes, locations and numbers of such engaging features (tabs or posts and slots) are possible according to aspects of the present invention without departing from its spirit and scope.

Relatedly, it will be appreciated that any such temporary engagement means, including the illustrated "bayonet coupling" arrangement, may again be employed in other contexts within the present invention, including but not limited to, for example, the engagement of an end of the tubing apparatus 20 with the receptacle 74 formed in the lid 72 of an ice chest 70 (FIGS. 4-7). That is, any such features may be substituted or combined in any appropriate manner according to aspects of the present invention. And where tabs 56 are formed on the second collar 54 of the tubing apparatus 20, it will be appreciated that such may serve the dual purpose, depending on the context or intended use, of selectively and temporarily engaging the tubing apparatus 20 with either an ice chest receptacle 74 or a funnel attachment rim 94, thereby rendering the apparatus 20 all the more multi-purpose or multi-functional. In any case, back to the alternative exemplary embodiment of FIGS. 8A and 8B, it will be appreciated that the second collar 54 is formed in such a way and as having such a length with the one or more fastener 60 thereon, if any, so located that the fastener 60 in no way interferes with the assembly of the funnel attachment 90 on the tubing apparatus 20 as illustrated. Again, any other means of such engagement or of maintaining the tubing apparatus 20 in its collapsed state may be employed beyond those shown and described.

Figure 9:
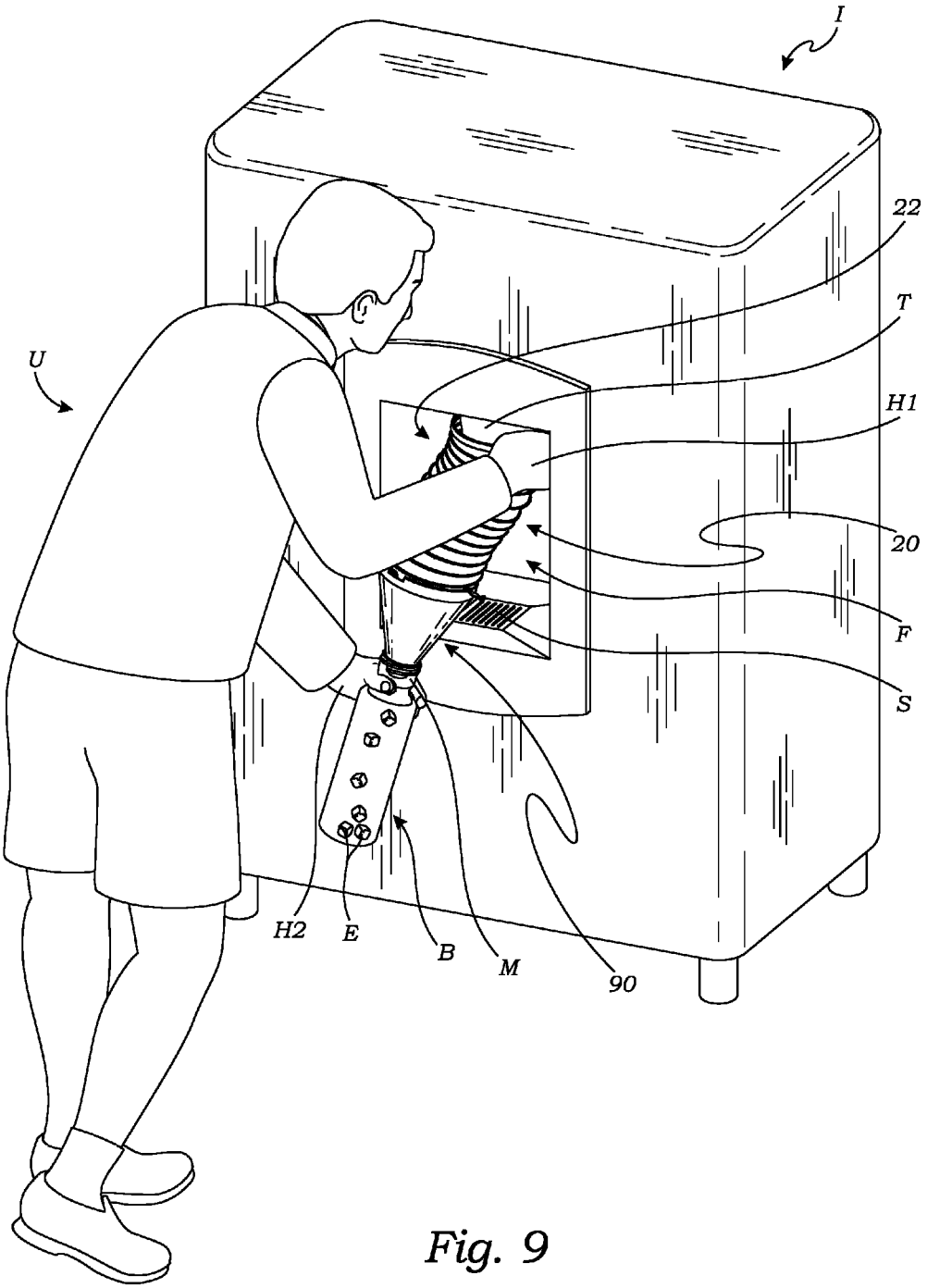
FIG. 9 is a reduced scale perspective view thereof in an expanded second operational mode in conjunction with a beverage bottle and an ice dispensing machine, in accordance with at least one embodiment.

FIG. 9 illustrates use of the alternative exemplary embodiment tubing apparatus 20 in conjunction with a funnel attachment 90 of FIGS. 8A and 8B. In this use, a user U fills a beverage bottle B with ice E from an ice dispensing machine I by employing such arrangement. Particularly, after having attached the funnel attachment 90 to the tubing apparatus 20 as described above, the user U may position the upper or first end 22 of the apparatus 20 on, about, or adjacent to the dispensing chute T and position small end, and particularly the outlet hole 98 of the funnel attachment 90 on, in, or adjacent to the mouth M of the beverage bottle B. Those skilled in the art will appreciate that a variety of beverage bottles B with a wide range of sizes and openings defined by their mouths M are known and used. Whether or not such beverage containers B can physically fit within the fill area F of a particular ice dispensing machine I so as to be placed directly underneath the chute T as by being sitting on the fill area shelf S, it is most often the case that the opening of the chute T is larger, sometimes significantly, than the opening of the bottle mouth M, on which basis inevitably during filling a substantial portion of the ice bounces off the bottle B and falls to the shelf S or on to the floor, again causing waste and mess and a potential "slip and fall" hazard. As such, it is desirable to be able to direct all or substantially all of the ice being dispensed from the chute T into the beverage or other container B, preferably without having to use one's hands as a makeshift "funnel," which of course has other disadvantages in terms of the hands being made cold and wet and also potentially contaminating the ice cubes going into the bottle B.

Alternatively, the user U may simply take the free or upper first end 22 of the tubing apparatus 20 in one hand H1 and the bottle B in the other hand H2, position the first end 22 of the apparatus 20 on, about, or adjacent to the dispensing chute T and the funnel attachment 90 configured at the second end 24 of the apparatus 20, and particularly the outlet hole 98 thereof, on, in, or adjacent to the dispensing chute T, and then operate the machine I, again such as by simply pressing on the chute T, so as to dispense ice E from the machine I and through the assembly 20, 90 and into the beverage bottle B. Those skilled in the art will appreciate based again on the variety of configurations of such bottles B that a related variety of funnel attachments 90, and particularly openings or outlet holes 98 thereof, are possible. In one exemplary embodiment wherein the cone 92 is substantially rigid, it will be appreciated that a nominal size outlet hole 98 of on the order of one to two inches (1-2 in.) would accommodate a substantial range of bottle sizes, whether fitting in or over any particular mouth M and thereby still "force" all or substantially all of the ice into the bottle B.

In a further alternative embodiment, the cone 92, in whole or in part, as in its outlet hole 98 and surrounding region, may be formed of a flexible or resilient material so as to accommodate a range of bottle openings or mouths M. Those skilled in the art will appreciate that a variety of such constructions and related materials, now known or later developed, may be employed according to aspects of the present invention without departing from its spirit and scope. Regardless, it will be appreciated that as a practical matter the funnel outlet hole 98 can or should only get so small before there becomes a concern about ice not passing through the hole 98 and thus having a blockage.

It will further be appreciated that in holding the tubing apparatus 20 and bottle B and/or funnel attachment 90 in position, and specifically holding the bottle B somewhat adjacent to the dispensing chute T, the tubing apparatus 20 may be in a relatively compressed configuration or operational mode even while in use; relatedly, it will be appreciated that the tubing apparatus 20 can be at virtually any stage of expansion or collapse during operation, from those uses illustrated in FIGS. 3 and 6 to even fully or substantially fully collapsing the tubing apparatus 20 in order to position the beverage bottle B even fully within the fill area F of the ice dispensing machine I so as to be positioned under the chute T on the shelf S for somewhat "hands free" filling, again while avoiding ice spillage and the related waste and mess, though those skilled in the art appreciating that any such uses will in part be further dictated by the configuration of the ice machine I, and the fill area F specifically, as well as the beverage bottle B itself. More generally, it is noted that any and all such containers of whatever size and configuration, whether coolers, ice chests, or beverage bottles as here, are commonly and generally referred to as "containers" or "a container"—it will be appreciated by those skilled in the art that any all such containers are to be encompassed within or anticipated for use with an ice dispensing tubing apparatus 20 according to aspects of the invention, such that any container shown or described is to be understood as exemplary and non-limiting.

Another aspect of the inventive subject matter includes methods of coupling a collapsible and expandable ice dispensing tubing apparatus with an ice dispenser and an ice chest (or any other types of container). Preferably the ice dispensing machine has a dispensing chute as described above. In one embodiment of the methods, the method comprises a step of positioning the first end of the apparatus adjacent to the chute. Then, the apparatus is selectively expanded to position the second end of the apparatus within the cooler. Then, the ice dispensing machine is operated to dispense ice from the chute and through the apparatus into the ice chest (or any type of cooler or container).

In a preferred embodiment, the method further continues with a step of collapsing the apparatus and storing the apparatus in a pocket of the cooler when the ice dispensing is completed. In some embodiments, the step of collapsing the apparatus may further comprises a step of fastening the apparatus with a fastener.

In other embodiments of the methods, the method comprises a step of operably installing the second end of the apparatus within the receptacle of an ice chest, and selectively expanding the apparatus to position the first end of the apparatus adjacent to the chute. Then the method continues with a step of operating the ice dispensing machine so as to dispense ice from the chute and through the apparatus and the receptacle into the ice chest.

Similarly, in this embodiment, the method may further continue with a step of collapsing the apparatus and storing the apparatus in a pocket of the cooler when the ice dispensing is completed. Then the method continues with a step of the step of storing the apparatus in the receptacle of the ice chest further comprises closing a receptacle door to completely conceal the apparatus.

In still another embodiment, the inventive subject matter includes a method of employing a collapsible and expandable ice dispensing tubing apparatus in conjunction with an ice dispensing machine having a dispensing chute and further in conjunction with a beverage bottle having a mouth. In this embodiment, the method includes a step of attaching a funnel attachment to the second end of the apparatus and positioning an outlet hole of the funnel attachment adjacent to the mouth of the beverage bottle. Then, the method continues with a step of selectively expanding the apparatus to position the first end of the apparatus adjacent to the chute. Then, the ice dispensing machine is operated to dispense ice from the chute and through the apparatus and the funnel attachment into the beverage bottle through the mouth.

Preferably, when the ice dispensing is completed, the method further continues with a step of detaching the funnel attachment from the second end of the apparatus; and collapsing the apparatus. In some embodiments, the step of collapsing the apparatus can further comprise a step of fastening the apparatus with a fastener.

Still another inventive subject matter includes a kit including a collapsible and expandable ice dispensing tubing apparatus. In some embodiment, the kit also includes an ice chest having a receptacle formed therein for selective operable receipt of the apparatus. In other embodiments, the kit further may further include a funnel attachment for selective operable engagement with the apparatus. It is also contemplated, that the kit may also include an instructional material that provides instructions on how to perform one or more methods described above.

Still another inventive subject matter includes use of a collapsible and expandable ice dispensing tubing apparatus described above and/or using one or methods described above.

In some embodiments, the numbers expressing quantities of ingredients, properties such as concentration, reaction conditions, and so forth, used to describe and claim certain embodiments of the inventive subject matter are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints and open-ended ranges should be interpreted to include only commercially practical values. The recitation of ranges of values herein is merely intended to serve as a shorthand method of referring individually to each separate value falling within the range. Unless otherwise indicated herein, each individual value within a range is incorporated into the specification as if it were individually recited herein. Similarly, all lists of values should be considered as inclusive of intermediate values unless the context indicates the contrary.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A collapsible and expandable ice dispensing tubing apparatus having a first end and a second end, the apparatus comprising:

a hollow flexible body having a first opening at the first end and a second opening at the second end, the body comprising a sheath and a reinforcing member; and a fastener configured to engage the first end with the second end and maintain the apparatus in a collapsed configuration when fastened.

2. The apparatus of claim 1, wherein the reinforcing member is a plurality of spaced apart rings.

3. The apparatus of claim 1, wherein the reinforcing member is a single helix.

4. The apparatus of claim 1, wherein the reinforcing member comprises a material selected from the group consisting of steel, aluminum, aluminum alloy, polypropylene, polystyrene, polyvinyl chloride ("PVC"), acrylonitrile butadiene styrene ("ABS"), polyethylene, high density polyethylene ("HDPE"), low density polyethylene ("LDPE"), polycarbonate, and polyurethane.

5. The apparatus of claim 1, wherein the sheath comprises a material selected from the group consisting of polypropylene, polyethylene, and polyester.

6. The apparatus of claim 1, wherein the sheath comprises an outer surface and an opposite inner surface, and the inner surface has antimicrobial and/or antibacterial properties.

7. The apparatus of claim 1, further comprising a first collar at the first end, and a second collar at the second end, and wherein the fastener is placed on at least one of the first and second collars.

8. The apparatus of claim 7, wherein the fastener comprises a hinged mount installed on the second collar and a clasp pivotally connected to the hinged mount and formed with a lip configured to selectively engage the first collar.

9. The apparatus of claim 7, wherein at least one of the first and second collars is operably installed within a receptacle formed in an ice chest communicating with an interior thereof.

10. The apparatus of claim 9, wherein the receptacle is formed in a lid of the ice chest.

11. The apparatus of claim 9, wherein the receptacle is formed having a pivotable door.

12. The apparatus of claim 9, wherein the receptacle is formed having a flange configured for engagement with at least one of the first and second collars, the flange having a sufficient depth to fully accommodate the apparatus in the collapsed configuration.

13. The apparatus of claim 9, wherein at least one of the first and second collars has a tab for selectively engaging with the receptacle.

14. The apparatus of claim 1, wherein at least one of the first and second ends is assembled with a funnel attachment.

15. The apparatus of claim 14, wherein the funnel attachment comprises a cone having a rim and an opposite outlet hole.

16. The apparatus of claim 15, further comprising a first collar at the first end, and a second collar at the second end, wherein the rim is configured to engage at least one of the first and second collars, the rim is formed with at least one slot, and at least one of the first and second collars has at least one tab for selectively engaging with the at least one slot.

17. The apparatus of claim 15, wherein the cone comprises a material selected from the group consisting of steel, aluminum, aluminum alloy, polypropylene, polystyrene, polyvinyl chloride ("PVC"), acrylonitrile butadiene styrene ("ABS"), polyethylene, high density polyethylene ("HDPE"), low density polyethylene ("LDPE"), polycarbonate, and polyurethane.

18. The apparatus of claim 15, wherein the cone comprises a material having antimicrobial or antibacterial properties.

19. A collapsible and expandable ice dispensing tubing apparatus having first and second ends in combination with an ice chest having a lid and a receptacle, the apparatus comprising:

a hollow flexible body having a first opening at the first end and a second opening at the second end, the body comprising a sheath and a reinforcing member; and a second collar at the second end, the second collar being placed within the receptacle of the ice chest;

wherein ice may be selectively dispensed into the ice chest through the body of the tubing apparatus and through the receptacle conveniently without having to open the lid of the ice chest.

20. The apparatus and ice chest combination of claim 19, wherein the receptacle is formed in the lid of the ice chest.

21. The apparatus and ice chest combination of claim 19, wherein the receptacle is formed having a pivotable door.

22. The apparatus and ice chest combination of claim 19, wherein the receptacle is formed having a flange configured for engagement with the second collar, the flange having a sufficient depth to fully accommodate the apparatus in the collapsed configuration.

23. The apparatus and ice chest combination of claim 19, wherein the second collar has a tab for selectively engaging with the receptacle.

24. A collapsible and expandable ice dispensing tubing apparatus having first and second ends in combination with a funnel attachment, the apparatus comprising:

a hollow flexible body having a first opening at the first end and a second opening formed at the second end, the body comprising a sheath and a reinforcing member;

a first collar at the first end and a second collar at the second end, the second collar being placed on a rim of the funnel attachment for communication between the body and the funnel attachment; and a fastener configured to engage the first end with the second end and maintain the apparatus in a collapsed configuration when fastened.

* * * * *